US009463564B2

(12) United States Patent
Macauda

(10) Patent No.: US 9,463,564 B2
(45) Date of Patent: Oct. 11, 2016

(54) ELECTRICAL POWER CORD WITH SUPPLEMENTAL SOCKET

(71) Applicant: Tom Macauda, Downers Grove, IL (US)

(72) Inventor: Tom Macauda, Downers Grove, IL (US)

( * ) Notice: Subject to any disclaimer, the term of this patent is extended or adjusted under 35 U.S.C. 154(b) by 0 days.

(21) Appl. No.: 14/839,615

(22) Filed: Aug. 28, 2015

(65) Prior Publication Data

US 2016/0064883 A1 Mar. 3, 2016

Related U.S. Application Data

(60) Provisional application No. 62/042,939, filed on Aug. 28, 2014.

(51) Int. Cl.

| | |
|---|---|
| ***B25F 5/00*** | (2006.01) |
| ***H01R 13/639*** | (2006.01) |
| ***H01R 25/00*** | (2006.01) |
| *H01R 13/713* | (2006.01) |
| *H01R 13/52* | (2006.01) |

(52) U.S. Cl.

CPC ..... *B25F 5/00* (2013.01); *H01R 13/6392* (2013.01); *H01R 25/003* (2013.01); *H01R 13/5202* (2013.01); *H01R 13/7135* (2013.01)

(58) Field of Classification Search

CPC ..... H01R 31/02

See application file for complete search history.

(56) References Cited

U.S. PATENT DOCUMENTS 2,675,444 A * 4/1954 Shapiro ..... H01H 85/547 337/147
2,774,048 A * 12/1956 Baenziger ..... F21L 14/00 362/378
2,979,624 A * 4/1961 Askerneese ..... H01R 25/003 200/51 LM (Continued)

FOREIGN PATENT DOCUMENTS

KR 1020040035650 A 4/2004
KR 1020100042174 A 4/2010

OTHER PUBLICATIONS

International Search Report and Written Opinion issued Nov. 16, 2015 in connection with PCT/US2015/047548.

*Primary Examiner* — Ross Gushi
(74) *Attorney, Agent, or Firm* — Corridor Law Group, P.C.

(57) ABSTRACT

A power cord with an integrated socket box located between its plug and connector has many advantages, especially in the construction industry. Power tools can be manufactured with this power cord so that one need not look for an extension cord when he is seeking to use a secondary tool. This power cord also allows for multiple parties to work from a single power source.

In some embodiments the power tool is an integral part of the electrical device, such as a power tool. In other embodiments, the power cord is permanently attached to the existing electrical device. In some cases a securing sheathe made of heat shrinking tubing is used to attach the power cord to the electrical device.

In some embodiments the integrated socket box can have more than one socket. In at least one embodiment the integrated socket box has a ground fault interrupter.

6 Claims, 7 Drawing Sheets

(56) References Cited

U.S. PATENT DOCUMENTS 3,177,358 A * 4/1965 Suttie ..... B25H 5/00 362/486
3,344,393 A * 9/1967 Hendee ..... H01R 13/6392 439/367
3,359,527 A * 12/1967 Hart ..... F21S 4/10 439/172
3,535,638 A * 10/1970 Michelin ..... F21V 33/00 324/149
3,584,213 A * 6/1971 Meltzer ..... F21L 14/00 362/295
4,019,047 A * 4/1977 Frey ..... F21V 21/0965 248/206.5
4,083,621 A * 4/1978 Davidson ..... H02G 11/02 439/501
4,141,062 A * 2/1979 Trueblood ..... F21L 14/02 362/186
4,195,106 A * 3/1980 Brusselmans ..... B29C 61/0616 156/84
4,275,435 A * 6/1981 Dorn ..... F21V 15/02 362/368
4,369,487 A * 1/1983 Carlow ..... F21V 27/00 362/258
4,370,518 A * 1/1983 Guzy ..... H02G 15/1806 156/49
4,395,640 A * 7/1983 Bone ..... H01R 25/165 220/3.9
4,457,527 A * 7/1984 Lowery ..... B25H 1/04 182/127
4,472,468 A * 9/1984 Tailor ..... B29C 61/10 156/308.4
4,496,795 A * 1/1985 Konnik ..... B32B 27/12 156/49
4,520,239 A * 5/1985 Schwartz ..... H02G 11/02 191/12.4
4,647,716 A * 3/1987 Akiyama ..... H01R 4/72 156/52
4,774,647 A * 9/1988 Kovacik ..... F21L 14/02 362/276
D298,657 S * 11/1988 Flores ..... H01R 4/72 D26/37
4,861,050 A * 8/1989 Bergeron ..... B62B 3/02 248/129
4,864,477 A * 9/1989 Engelman ..... F21V 15/02 362/373
4,867,701 A * 9/1989 Wiand ..... H01R 25/006 248/205.3
4,896,904 A * 1/1990 Gadsden ..... B29C 61/0616 156/86
4,915,990 A * 4/1990 Chang ..... B29C 61/065 138/103
5,047,594 A * 9/1991 Powell ..... H01R 4/70 136/232
5,083,241 A * 1/1992 Foster ..... A47B 97/00 108/23
5,134,000 A * 7/1992 Smythe ..... B29C 61/10 138/104
5,219,446 A * 6/1993 Klepac ..... B25H 3/02 362/154
5,234,360 A * 8/1993 Kramer, Jr. ..... H01R 25/003 439/367
5,236,374 A * 8/1993 Leonard ..... H01R 31/02 439/505
5,238,416 A * 8/1993 Dickie ..... H01R 13/443 439/142
5,243,136 A * 9/1993 Chen ..... H01R 31/02 174/135
5,259,782 A * 11/1993 Giffin ..... H01R 13/6392 439/314
5,298,300 A * 3/1994 Hosoi ..... B29C 61/0616 174/DIG. 8
5,359,540 A * 10/1994 Ortiz ..... G06F 1/266 307/115
5,369,559 A * 11/1994 Hedrick ..... F21V 15/02 362/376
D358,366 S * 5/1995 Sciortino ..... H01R 4/72 D13/120
5,424,903 A * 6/1995 Schreiber ..... G06F 1/266 307/40
5,430,598 A * 7/1995 Rodolfo ..... H01H 47/001 307/141
5,439,390 A * 8/1995 Raynor ..... H01R 25/003 439/491
5,642,248 A * 6/1997 Campolo ..... H01R 13/7135 361/115
5,657,841 A * 8/1997 Morvan ..... H02G 11/02 191/12.4
5,708,554 A * 1/1998 Liner ..... H01R 13/68 340/639
5,721,934 A * 2/1998 Scheurich ..... G06F 1/26 710/18
5,755,465 A * 5/1998 Stewart, Jr. ..... H02G 15/1806 156/86
5,755,588 A * 5/1998 Sweatman ..... H01R 13/6392 439/369
5,772,462 A * 6/1998 Osten ..... H01R 13/6392 439/367
5,793,352 A * 8/1998 Greenberg ..... G09G 5/006 345/699
5,833,357 A * 11/1998 Ting ..... F21L 14/02 362/376
5,855,494 A * 1/1999 Blaszczyk ..... H01R 31/02 361/735
5,902,148 A * 5/1999 O'Rourke ..... H01R 25/003 439/505
5,904,591 A * 5/1999 Shiau ..... G06F 1/266 307/38
5,917,694 A * 6/1999 Denny ..... A45D 1/00 206/372
5,931,702 A * 8/1999 Fladung ..... H01R 13/6392 439/369
6,036,525 A * 3/2000 Alfis, III ..... H01R 13/5213 439/367
6,042,418 A * 3/2000 Cummings ..... A47G 33/08 439/505
6,058,612 A * 5/2000 Leyva ..... H01R 25/006 30/388
6,170,966 B1 * 1/2001 Schwarzmann ..... F21L 14/02 362/277
6,179,665 B1 * 1/2001 Rossman ..... H01R 13/72 439/131
6,211,581 B1 * 4/2001 Farrant ..... G06F 1/266 307/115
6,329,616 B1 * 12/2001 Lee ..... H01R 25/003 200/51 R
6,355,318 B1 * 3/2002 Tailor ..... B29C 66/49 138/109
6,428,181 B1 * 8/2002 Moriarty ..... B25H 3/02 362/154
6,445,087 B1 * 9/2002 Wang ..... H01R 25/003 307/139
6,455,779 B1 * 9/2002 Jones ..... H01R 4/72 174/93
6,540,549 B2 * 4/2003 Rupert ..... H01R 25/003 439/215
6,573,617 B2 * 6/2003 Jones ..... H01R 13/514 307/11
6,586,849 B2 * 7/2003 Tarr ..... G06F 1/266 307/139
6,666,712 B1 * 12/2003 Kramer ..... G06F 1/266 439/501
6,702,608 B2 * 3/2004 Brennan, Jr. ..... B25H 3/00 280/47.19
6,744,150 B2 * 6/2004 Rendic ..... G06F 1/266 307/115
6,750,410 B2 * 6/2004 Lee ..... C08J 9/0004 200/51 R
6,767,255 B1 * 7/2004 Croswell ..... H01R 25/003 439/106
6,780,048 B2 * 8/2004 Chen ..... G06F 1/266 439/502
6,805,579 B2 * 10/2004 Marchand ..... H01R 13/443 174/71 R

(56) References Cited

U.S. PATENT DOCUMENTS 6,811,444 B2 * 11/2004 Geyer ..... G06F 1/266 307/38
6,862,403 B2 * 3/2005 Pedrotti ..... A01M 1/2072 392/392
6,929,514 B1 * 8/2005 Chuang ..... H01R 31/02 439/108
6,940,015 B2 * 9/2005 Fang ..... H01R 13/465 174/50
7,057,108 B1 * 6/2006 Sodemann ..... H01R 13/7135 174/71 R
7,101,215 B2 * 9/2006 Woellner ..... H01R 13/639 439/371
7,104,847 B2 * 9/2006 Sodemann ..... H02J 9/066 290/1 A
7,132,763 B2 * 11/2006 Rendic ..... G06F 1/266 307/31
7,162,378 B2 * 1/2007 Hynds ..... H01R 13/6397 702/122
7,174,994 B1 * 2/2007 Coffield ..... E06C 1/39 182/129
7,198,511 B2 * 4/2007 Brennan, Jr. ..... B25H 3/00 280/47.19
7,210,960 B2 * 5/2007 Mak ..... H01R 13/504 439/505
7,229,302 B1 * 6/2007 Lai ..... H01R 25/003 439/214
7,230,214 B2 * 6/2007 Kirby ..... H01R 4/72 174/76
7,239,892 B2 * 7/2007 Martin ..... H04B 3/54 370/328
7,273,215 B1 * 9/2007 Smith ..... B25H 3/028 280/32.6
7,318,485 B2 * 1/2008 Greese ..... B25B 21/00 173/1
7,358,625 B2 * 4/2008 Cheng ..... H01R 13/6675 307/18
7,371,121 B1 * 5/2008 Lee ..... H01R 13/7175 439/650
7,416,440 B2 * 8/2008 Homyk ..... H01R 31/06 439/502
7,455,546 B1 * 11/2008 Yoon ..... H01R 13/6392 439/369
7,495,431 B2 * 2/2009 Sun ..... G01R 15/125 324/114
7,537,485 B2 * 5/2009 Bell ..... G06F 1/1632 439/505
7,553,181 B1 * 6/2009 Van Dalinda, III ..... H01R 13/6392 174/92
D603,542 S * 11/2009 Moss ..... H01R 4/72 D26/51
7,635,208 B2 * 12/2009 Hedrick ..... F21L 14/02 16/110.1
7,663,866 B2 * 2/2010 Lee ..... H01R 13/652 307/117
7,688,563 B2 * 3/2010 O'Rourke ..... H02H 7/228 361/103
7,758,202 B2 * 7/2010 Krieger ..... B65H 75/425 108/23
7,791,864 B2 * 9/2010 Matyas ..... H01H 85/24 337/11
7,808,761 B2 * 10/2010 O'Rourke ..... H02H 7/228 361/103
7,843,081 B2 * 11/2010 Lim ..... H01R 13/6641 307/11
7,905,736 B2 * 3/2011 O'Rourke ..... H01R 13/6392 439/214
7,906,869 B2 * 3/2011 Lee ..... H02J 13/0075 307/38
7,950,941 B1 * 5/2011 Wang ..... H01R 25/003 439/214
7,956,492 B2 * 6/2011 Lee ..... G06F 1/266 307/115
7,988,494 B2 * 8/2011 Lee ..... H01R 13/713 439/652
7,989,718 B1 * 8/2011 Weber ..... B23B 39/10 200/310
7,994,654 B2 * 8/2011 Lee ..... G06F 1/266 307/39
8,007,130 B2 * 8/2011 Wu ..... H01R 33/955 362/249.06
8,029,307 B2 * 10/2011 O'Rourke ..... H01R 13/6392 439/372
8,033,867 B1 10/2011 Kessler et al.
8,093,750 B2 * 1/2012 Ko ..... G06F 1/266 307/38
8,127,126 B2 * 2/2012 Lai ..... G06F 1/266 439/505
8,129,859 B2 * 3/2012 Pien ..... H02J 3/14 307/39
8,149,570 B2 * 4/2012 Keebler ..... H02J 7/0055 307/11
8,220,645 B2 * 7/2012 Robinson ..... B43M 99/001 206/224
8,271,815 B2 * 9/2012 Lin ..... G06F 1/266 713/300
8,292,657 B2 * 10/2012 Singh ..... H01R 13/6633 307/38
8,301,271 B2 * 10/2012 Lee ..... G06F 1/3203 700/18
8,317,374 B2 * 11/2012 Hedrick ..... F21L 14/02 362/398
8,376,782 B2 * 2/2013 Govekar ..... H01R 25/006 439/502
8,408,929 B2 * 4/2013 Solon ..... H01R 13/639 439/301
8,469,746 B2 * 6/2013 Kemp ..... H02J 7/0045 439/628
8,480,416 B2 * 7/2013 Farris-Gilbert ..... H01R 13/652 439/131
8,502,414 B2 * 8/2013 Lee ..... G06F 1/266 307/31
8,574,010 B2 * 11/2013 Wu ..... H01R 13/635 439/160
8,585,434 B2 * 11/2013 Yu ..... H01R 13/53 439/110
8,602,806 B2 * 12/2013 Chou ..... H01R 13/6392 439/345
8,616,912 B1 * 12/2013 Vendura ..... E06C 7/00 439/368
8,668,516 B2 * 3/2014 Lee ..... H01R 13/6691 439/489
8,674,556 B2 * 3/2014 Tinaphong ..... H01R 13/6683 307/126
8,691,393 B2 * 4/2014 Cook ..... H05K 9/0084 174/102 R
8,701,568 B2 * 4/2014 Miller ..... H01R 4/72 108/50.02
8,702,440 B2 * 4/2014 Nooner ..... H01R 13/5213 439/279
8,834,198 B2 * 9/2014 O'Rourke ..... H01R 4/72 361/103
8,834,209 B2 * 9/2014 Conrad ..... H01R 13/6456 439/680
8,862,916 B2 * 10/2014 Lee ..... G06F 1/266 713/320
8,896,150 B1 * 11/2014 Shammoh ..... H01R 13/70 307/31
9,099,802 B2 * 8/2015 Beharrell ..... H01R 13/514
9,147,985 B1 * 9/2015 Noriega ..... H01R 25/003
9,224,994 B2 * 12/2015 Ota ..... H02J 1/10
9,231,341 B2 * 1/2016 Appel ..... B25D 17/00
9,276,366 B1 * 3/2016 Flores ..... H01R 24/66
9,287,706 B2 * 3/2016 Brewer ..... H02J 3/00
2002/0055300 A1 * 5/2002 Scherb ..... H01R 4/72 439/523
2002/0189848 A1 * 12/2002 Hawker ..... H01R 31/02 174/149 B
2003/0176101 A1 * 9/2003 Miller, Jr. ..... H01R 25/006 439/535
2004/0092158 A1 * 5/2004 Chien ..... H01R 31/06 439/505
2004/0097120 A1 * 5/2004 Limber ..... H01R 13/6392 439/369

(56) References Cited

U.S. PATENT DOCUMENTS

2004/0100049 A1* 5/2004 Deasy ..... B25H 5/00 280/32.6
2004/0221181 A1* 11/2004 Yu ..... G06F 1/266 713/300
2004/0248462 A1* 12/2004 Dyer ..... H01R 29/00 439/502
2005/0020111 A1* 1/2005 Pagac ..... H01R 13/60 439/134
2005/0135108 A1* 6/2005 Delano ..... F21V 21/0885 362/396
2006/0014411 A1* 1/2006 Stair ..... H01R 13/6392 439/271
2006/0278794 A1* 12/2006 Rast ..... A47B 21/06 248/346.01
2007/0026728 A1* 2/2007 Mak ..... H01R 13/504 439/505
2007/0077810 A1* 4/2007 Gogel ..... H01R 13/60 439/505
2007/0270025 A1* 11/2007 Mabry ..... H01R 13/72 439/470
2008/0012423 A1* 1/2008 Mimran ..... H01R 25/003 307/11
2008/0014844 A1* 1/2008 Pontieri ..... B24B 23/022 451/359
2008/0022479 A1* 1/2008 Zhao ..... A47L 7/0085 15/319
2008/0035507 A1* 2/2008 Collister ..... B25H 3/006 206/349
2008/0057780 A1* 3/2008 O'Rourke ..... H01R 13/213 439/505
2008/0311795 A1* 12/2008 Brotto ..... B25F 5/029 439/628
2009/0091192 A1* 4/2009 Robertson ..... G06F 1/266 307/125
2009/0125743 A1* 5/2009 Robertson ..... G06F 1/266 713/324
2009/0146494 A1* 6/2009 Mori ..... G06F 1/266 307/38
2009/0215319 A1* 8/2009 Gandhi ..... H01R 13/7038 439/654
2009/0280671 A1* 11/2009 Kierstead ..... H01R 13/6392 439/346
2009/0289501 A1* 11/2009 Garb ..... G06F 1/266 307/39
2010/0044195 A1* 2/2010 Chiang ..... G06F 1/266 200/175
2010/0068913 A1* 3/2010 Edge ..... H01R 13/6392 439/369
2010/0164284 A1* 7/2010 Lee ..... G06F 1/266 307/38
2010/0164299 A1* 7/2010 Lee ..... H02J 3/14 307/115
2010/0328953 A1* 12/2010 Wu ..... H01R 33/955 362/249.14
2011/0083022 A1* 4/2011 Lai ..... G06F 1/266 713/300
2011/0097923 A1* 4/2011 Lee ..... H01R 13/70 439/369
2011/0175711 A1* 7/2011 Kuo ..... G06F 1/266 340/12.32
2011/0215759 A1* 9/2011 Lee ..... G06F 1/266 320/115
2012/0028505 A1* 2/2012 Weber ..... H01R 25/003 439/638
2012/0115349 A1* 5/2012 Kierstead ..... H01R 13/639 439/369
2012/0220164 A1* 8/2012 Flynn ..... H01R 24/22 439/535
2012/0252248 A1* 10/2012 Farris-Gilbert ..... H01R 13/652 439/284
2013/0244475 A1 9/2013 Sayadi et al.
2014/0024247 A1* 1/2014 Riesgaard ..... H01R 31/06 439/502
2014/0065886 A1* 3/2014 Lee ..... H01R 27/02 439/628
2014/0302701 A1* 10/2014 Brillant ..... H01R 13/6392 439/369
2014/0315412 A1* 10/2014 Tripp ..... H01R 13/6392 439/349
2015/0111418 A1* 4/2015 Vallon ..... H01R 13/72 439/501

* cited by examiner

ELECTRICAL POWER CORD WITH SUPPLEMENTAL SOCKET

CROSS-REFERENCE TO RELATED APPLICATIONS

This application is related to and claims priority from U.S. Provisional Application No. 62/042,939 filed Aug. 28, 2014 entitled "Electrical Power Cord With Supplemental Socket." The '939 application is hereby incorporated by reference in its entirety.

FIELD OF THE INVENTION

The present disclosure relates to electrical power cords and, more specifically, power cords, cord sets and extension cords with one or more power sockets.

BACKGROUND OF THE INVENTION

A power cord is an electrical cable used to connect an electrical device or appliance to a source of electrical power such as a mains electricity supply outlet or an extension cord connected to a mains outlet.

In one case, a power cord comprises a length of flexible electrical power cable, a male connector (or plug) at one end, and a female connector (socket, port or outlet) at the other end.

A power cord comprising an integrated connector at each end, one male and one female, is typically known as a cord set. Cord sets are usually detachable from the power supply and the device.

In another case, a power cord for a device has a length of flexible electrical power cable and a male connector at one end, with the other end electrically connected directly to the device. In this case, the power cable can be conjoined with the device, or at least securely fastened to the device, and is not intended be detached by a user.

An extension cord is a convenient way to provide power to an electrical device or appliance located a distance way from a suitable power outlet or source of electrical power. Like a power cord, an extension cord typically has a length of flexible electrical power cable, a male connector (or plug) at one end, and a female connector (socket, port or outlet) at the other end.

Generally, the plug and the socket are of the same type of connector, the plug connects to a mains outlet and the socket mates with a plug attached to the electrical device.

Extension cords can be used in household applications, for example to provide power to a lamp, an electronic device or a household appliance. Extension cords can also be used in construction environments and industrial applications, for example to provide power to a power tool. Extension cords can be used in indoor and outdoor situations.

The power cable in a power cord or an extension cord has a number of wires, each wire with a suitable gauge. The number of wires and the gauge of each wire is determined, at least in part, by the distance along the cable from the plug to the socket, and by the maximum electrical current to be carried by the cable.

Electrical devices such as power tools can have supplemental sockets on the body of the devices. One disadvantage is that work being done by the first device (for example a power tool) can interfere with work being done (sometimes by a different operator) by a second device connected to the supplemental socket.

Also, there is an increased risk of damage to an electrical cable supplying the second tool if it is connected to the supplemental socket on the body of the tool than if it is receiving power from a socket not located on the body of the tool.

There can also be practical limitations with locating a supplemental socket on the body of the tool, for example, size of the socket relative to the size of the tool, and heat dissipation.

SUMMARY OF THE INVENTION

One often finds himself or herself in need of additional power outlets. While traditional power strips can be used in many instances, often it would be convenient if the electrical device currently occupying one of the main outlets, had its own socket box. This is especially true in the construction industry, in which workers are often switching between multiple power tools.

A power cord with an integrated socket box located between its plug and connector has many advantages. In some embodiments the power cord can be an integral part of an electrical device, such as a power tool. Power tools can be manufactured with this power cord so that one need not look for an extension cord when he is seeking to use a secondary tool. This power cord would allow for multiple parties to work from a single power source.

In other embodiments, the power cord can be permanently attached to an existing electrical device. This allows a user to retrofit older electronic devices. In some cases a securing sheathe made of heat shrinking tubing is used to attach the power cord to the electrical device, although other securing methods are possible.

A plug-in electrical device includes a main device; and a power cord, wherein the power cord has a plug, a socket box, and a length of electrical wire.

In some embodiments the main device is a power tool. In certain embodiments the main device is a circular saw. In other embodiments the main device is a router. In further embodiments the main device is an air-compressor.

In certain embodiments the plug is integrated into the main device. In other or the same embodiments the socket box is located along the length of electric wire between the main device and the plug.

In some embodiments the socket box includes a first socket. In other or the same embodiments the socket box includes a second socket. In other or the same embodiments the socket box includes a ground fault interrupter.

A power cord can include a plug, a length of electric wire, an end socket; and a socket box, wherein the socket box is located along the length of electric wire between the plug and the end socket.

In some embodiments the socket box includes a first socket. In other or the same embodiments the socket box includes a second socket. In other or the same embodiments the socket box includes a ground fault interrupter.

In some embodiments the power cord can include a securing sheathe wherein the sheathe is configured to secure the end socket to a second electrical plug. In some embodiments the second electrical plug is connected to a power tool. In certain embodiments the securing sheathe is a heat shrinking tubing. In other or the same embodiments the securing sheathe is waterproof.

A power block includes a plug and a socket box, and magnet and a clip. In some embodiments the socket box can include a first socket, a second socket, a USB port, and/or a a ground fault interrupter.

DETAILED DESCRIPTION OF PREFERRED EMBODIMENT(S)

The present apparatus relates to the supply of electrical power to one or more electrical devices or appliances.

The present apparatus is particularly suitable for situations where more than one device requires electrical power from the same mains outlet.

Figure 1:
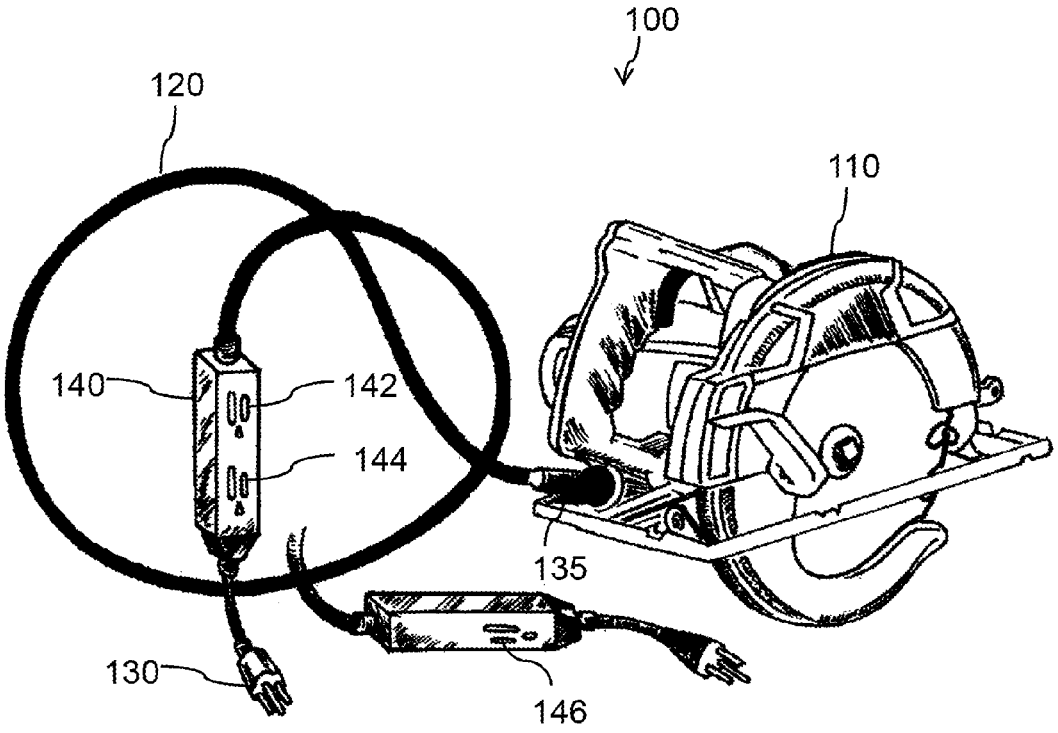
FIG. 1 is a perspective view of a portable circular saw with an integrated multi-socket power cord.

FIG. 1 is a perspective view of portable circular saw 100 with an integrated multi-socket power cord. Circular saw 100 comprises circular saw tool 110, power cable 120, plug 130 and connection 135.

Plug 130 and power cable 120 can be configured to work with a wide variety of voltages, including but not limited to 110 and 220 volts.

Circular saw 100 further has socket box 140 integrated into power cable 120. Socket box 140 can have one or more sockets such as sockets 142, 144 and 146 shown in FIG. 1.

Socket box 140 can be located at a suitable position along power cable 120. In the example embodiment shown in FIG. 1, socket box 140 is located close to plug 130. In other embodiments, socket box 140 can be located close to connection 135 and, in yet other embodiments, socket box 140 can be located at an intermediate position along power cable 120.

In some embodiments, two or more socket boxes 140 can be integrated into power cable 120, each socket box 140 comprising one or more sockets such as sockets 142, 144 and 146.

When plug 130 is connected to a mains power supply, sockets 142, 144 and 146 can be used to supply power to electrical devices.

A benefit of integrating power cable 120 and socket box 140 with circular saw tool 110 via connection 130 is that the one or more additional sockets (such as sockets 142, 144 and 146) are conveniently located and readily accessible to the operator of circular saw 100.

Figure 2:
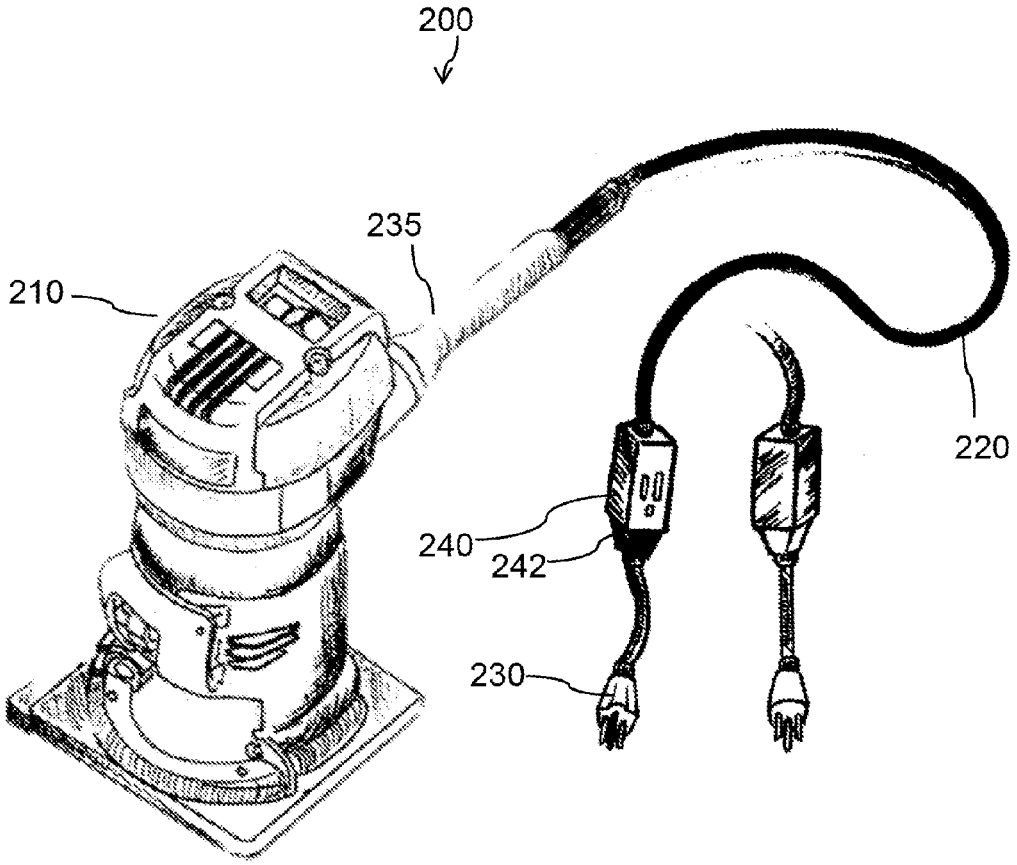
FIG. 2 is a perspective view of a router with an integrated multi-socket power cord.

FIG. 2 is a perspective view of router 200 with an integrated multi-socket power cord. Router 200 has router tool 210, power cable 220, plug 230 and a connection 235.

In some embodiments, router 200 can have socket box 240 integrated into power cable 220. Socket box 240 can have one or more sockets such as socket 242 shown in FIG. 2. When plug 230 is connected to a mains power supply, socket 242 can be used to supply power to an electrical device.

Figure 3A:
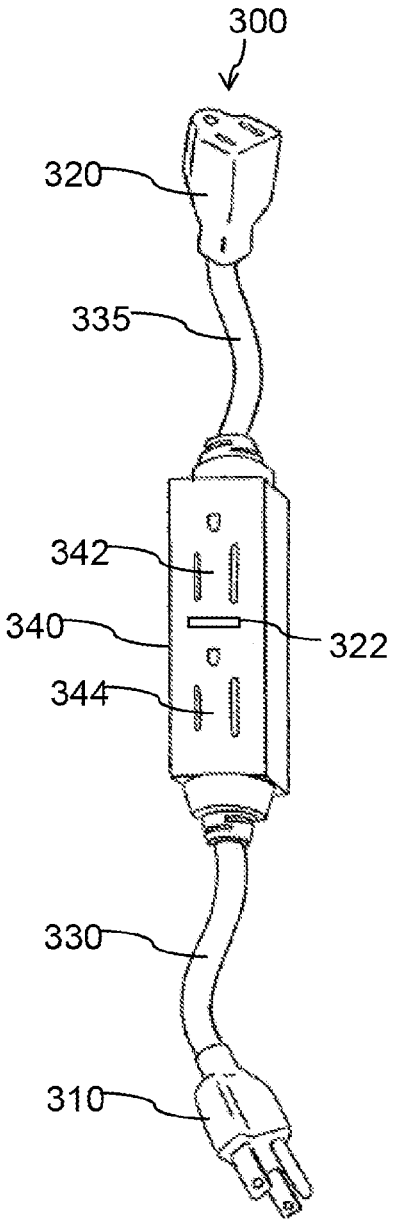
FIG. 3A is a front perspective view of a multi-socket extension cord.
Figure 3B:
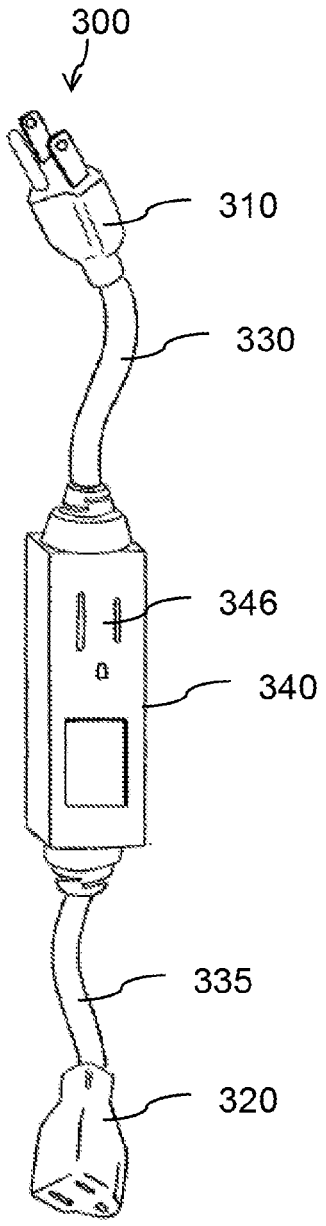
FIG. 3B is a back perspective view of the multi-socket extension cord of FIG. 3A.

FIG. 3A is a front perspective view of multi-socket extension cord 300. FIG. 3B is a back perspective view of multi-socket extension cord 300 of FIG. 3A.

Multi-socket extension cord 300 has male connector (or plug) 310, female connector (or socket) 320, and socket box 340. A first length of power cable 330 connects plug 310 to socket box 340, and second length of power cable 335 connects socket 320 to socket box 340.

Socket box 340 can have one or more sockets such as sockets 342, 344 and 346 as shown in FIG. 3. When plug 310 is connected to a main power supply, sockets 320, 342, 344 and 346 can supply power to electrical devices.

In some embodiments, socket box 340 can include Universal Serial Bus (USB) port 322. USB port 322 allows for various electronics, such as many smartphones and tablets, to be charged and/or powered directly from extension cord 300 without the need of an adapter. USB port 322 can be one of any of the several standards including, but not limited to, USB 1.x, USB 2.0, USB 3.0, and any future standards.

Figure 4:
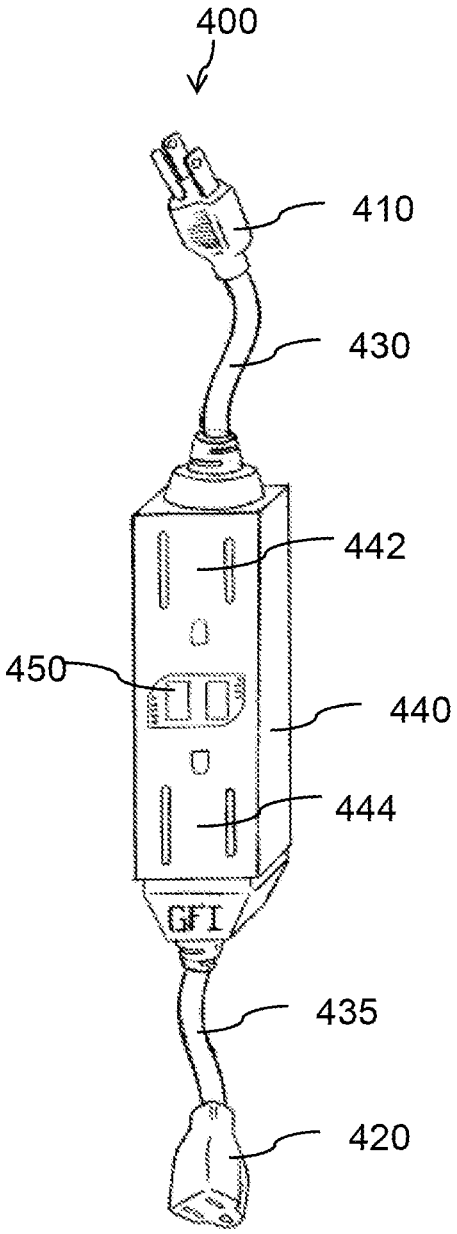
FIG. 4 is a perspective view of a multi-socket extension cord with an integrated ground fault interrupter (GFI).

FIG. 4 is a perspective view of multi-socket extension cord 400 with an integrated ground fault interrupter (GFI).

Multi-socket extension cord 400 can have male connector (or plug) 410, female connector (or socket) 420, and socket box 440. First length of power cable 430 connects plug 410 to socket box 440, and second length of power cable 435 connects socket 420 to socket box 440.

In some embodiments, socket box 420 can light up to indicate that extension cord 400 is connected to an active power source. In other or the same embodiments, socket box 440 can include an indicia that indicates when extension cord 400 is connected to an active power source.

Socket box 440 can have one or more sockets such as sockets 442 and 444 as shown in FIG. 4. When plug 410 is connected to a main power supply, sockets 420, 442 and 444 can supply power to electrical devices.

In some embodiments, socket box 440 can have ground fault interrupter (GFI) 450. GFI 450 is desirable in situations such as when electrical devices powered via extension cord 400 are used in bathrooms or kitchens, outdoors, near swimming pools, or in connection with wet saws, wet-dry vacuums, and other power tools that are used with or near water. GFI 450 is configured to detect a leakage current of a few mA and trip a circuit breaker thereby reducing the risk of an electric shock to the user.

GFI 450 can comprise a "test" button and a "reset" button. When pressed, a "test" button simulates an electrical short by causing a small difference between the "hot" and "neutral" currents. If GFI 450 is working correctly, the test trips the circuit breaker. The breaker can be reset using the "reset" button.

A benefit of multi-socket extension cord 400 with integrated GFI is safer operation especially in environments presenting a shock hazard such as bathrooms. When no mains outlet comprising GFI is conveniently available, multi-socket extension cord 400 can provide GFI protection and reduce the risk of electric shock or other consequences of an electrical short.

Figure 5:
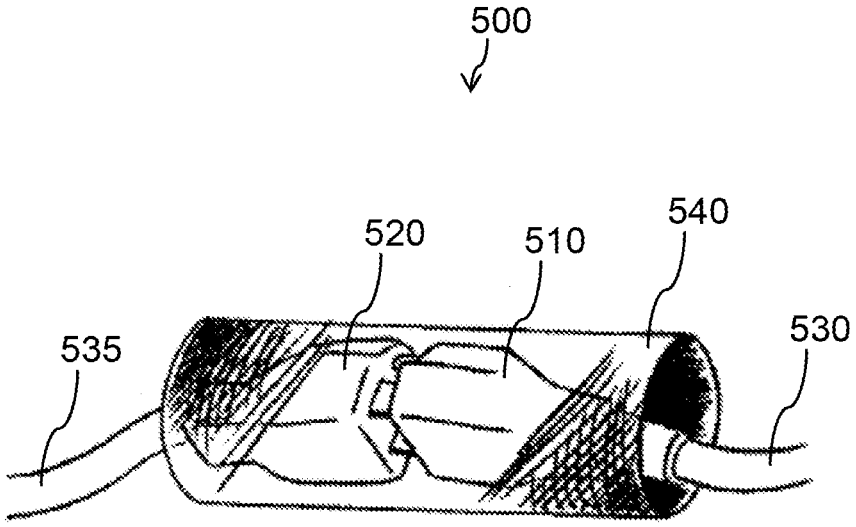
FIG. 5 is a perspective view of a mechanism for securely conjoining two power cords or extension cords.

FIG. 5 is a perspective view of a mechanism 500 for securely conjoining two power cords or extension cords.

In the example shown in FIG. 5, plug 510 is at one end of a power cord connected to an electrical device (not shown in FIG. 5). A first length of power cable 530 connects plug 510 to the electrical device.

Socket 520 is at one end of an extension cord connectable to a mains supply outlet (not shown in FIG. 5). A second length of power cable 535 connects socket 520 to the mains supply outlet. The extension cord can be a multi-socket extension cord such as extension cord 400 of FIG. 4 or an extension cord with GFI such as extension cord 500 of FIG. 5.

A length of heat shrink tubing (or sleeve) 540 can be used to seal the connection between plug 510 and socket 520. Sleeve 540 can comprise mechanically expanded extruded plastic, for example, that shrinks around its diameter when heated. For the purposes of illustration, sleeve 450 is shown in FIG. 5 in its state prior to shrinking.

When sleeve 540 is shrunk, it forms a seal around the connection between plug 510 and socket 520. Sleeve 540 securely fastens the power cord to the extension cord, and is not intended to be detached by the user.

In the example embodiment shown in FIG. 5, sleeve 540 can be slid over plug 510 and around cable 530 before a connection is made between plug 510 and socket 520. Once the connection is made, sleeve 540 can be slid over the connection. It is generally desirable that sleeve 540 covers both plug 510 and socket 520 in their entirety, thereby providing a secure connection and, optionally, insulation and/or waterproofing.

In other embodiments, other suitable mechanisms can be used for securely and/or permanently fastening plug 510 to socket 520.

A benefit of mechanism 500 of FIG. 5 is that a cord comprising an integrated socket box (such as socket box 140 of FIG. 1, 240 of FIG. 2, 340 of FIG. 3 and 440 of FIG. 4) can be retrofitted to an existing power cord. The existing power cord and the cord comprising the integrated socket box can be conjoined using the mechanism shown described in FIG. 5 or another suitable mechanism. The resulting conjoined cord has the benefits of a multi-socket power cord described above.

Figure 6:
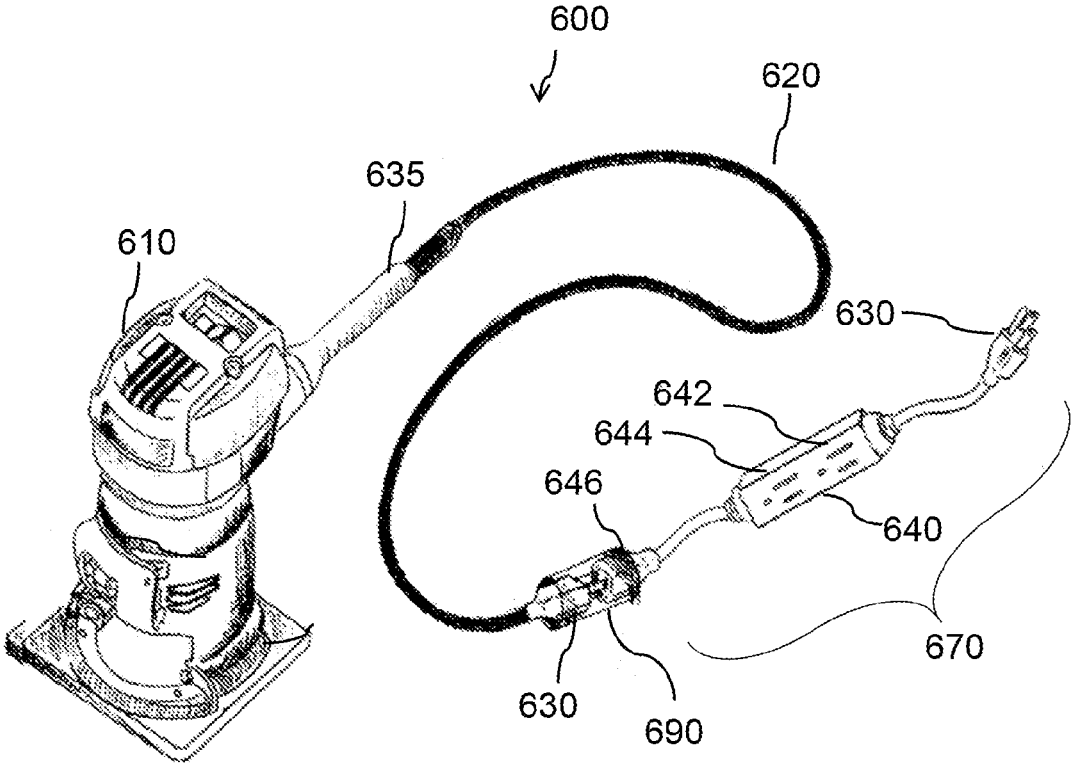
FIG. 6 is an exploded perspective view of a router with an integrated multi-socket power cord attached via the mechanism illustrated in FIG. 5.

FIG. 6 is a perspective view of router 600 with an integrated multi-socket power cord 670 connected via sleeve 690. Router 600 has router tool 610, power cable 620, plug 630 and a connection 635.

In some embodiments integrated multi-socket power cord 670 is connected to plug 630 via socket 646. Plug 630 and socket 646 can be covered via sleeve 690. Integrated multi-socket power cord 670 can comprises socket box 640 with one or more sockets such as sockets 642 and 644. When plug 630 is connected to a mains power supply, sockets 642 and 644 can be used to supply power to an electrical device.

Figure 7A:
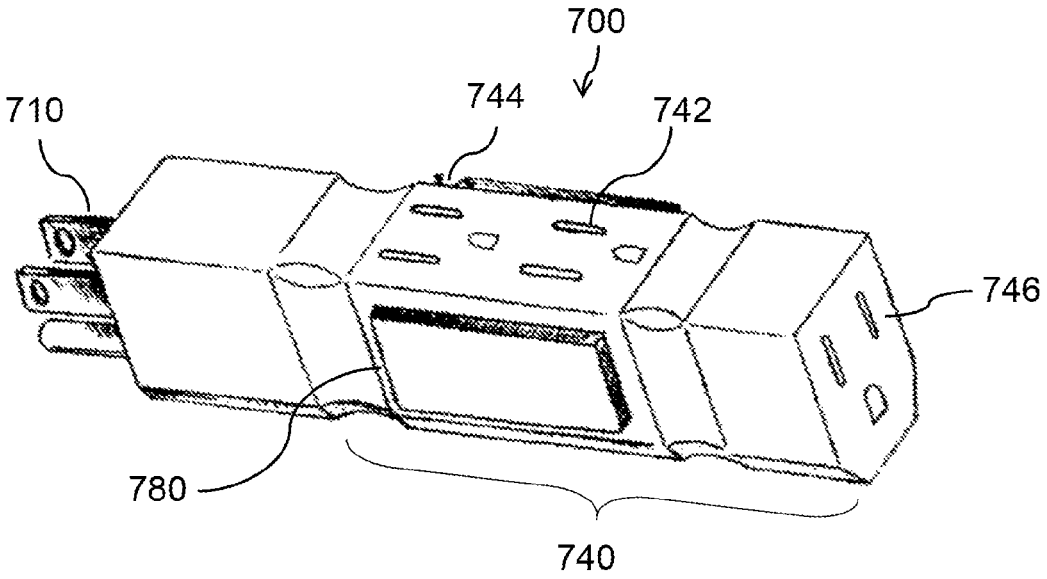
FIG. 7A is a front perspective view of a multi-socket power block.
Figure 7B:
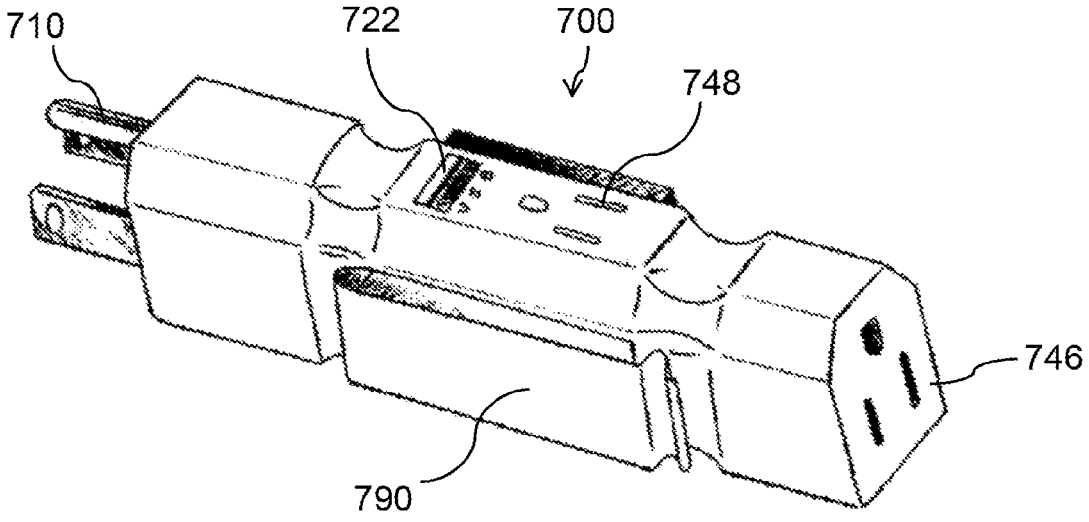
FIG. 7B is a back perspective view of a multi-socket power block of FIG. 7A.

FIG. 7A is a front perspective view of multi-socket power block 700. FIG. 7B is a back perspective view of multi-socket power block 700 of FIG. 7A.

Multi-socket power block 700 has male connector (or plug) 710 and socket box 740. In some embodiments (such as that shown in FIGS. 7A and 7B) multi-socket power block 700 has no flexible cords.

Socket box 740 can have one or more sockets such as sockets 742, 744, 746, and 748 as shown in FIGS. 7A and 7B. When plug 710 is connected to a main power supply, sockets 742, 744, 746, and 748 can supply power to electrical devices.

In some embodiments, socket box 740 can include Universal Serial Bus (USB) port 722. USB port 722 allows for various electronics, such as many smartphones and tablets, to be charged and/or powered directly from multi-socket power block 700 without the need of an adapter. USB port 722 can be one of any of the several standards including, but not limited to, USB 1.x, USB 2.0, USB 3.0, and any future standards.

In some embodiments multi-socket power block 700 can include magnet 780 and/or clip 790. Magnet 780 can we used to attach multi-socket power block 700 to a magnetic surface such as a user's truck, ladder or utility belt. Similarly clip 790 can be used to attach multi-socket power block 700 to a user's truck, ladder or utility belt.

In some embodiments multi-socket power block 700 can include ground fault interrupter (GFI) (not shown).

In the embodiments described above in reference to FIG. 1 through FIG. 7B, the plug and the socket are generally of the same type of connector. Similarly, the sockets in the socket box are generally of the same type of connector as each other, and as the plug and socket at each end of the power cord or extension cord.

In other embodiments, the plug and the sockets can be different types of connectors, for example when the power cord is configured to adapt an electrical device for use in a different country than originally intended. Likewise, one or more sockets in the socket box can be different types of connector to each other, and/or to the plug or socket at each end of the power cord.

In some embodiments, a multi-socket power or extension cord, such as those described in reference to FIG. 1 through FIG. 7B, can comprise one or more switches, each switch configured to turn power on and off to a corresponding socket. A benefit of integrating switches into the power or extension cord is improved safety and the capability to operate a device independently of other devices when more than one device is connected to the cord.

In some embodiments, a multiple-socket power block or extension cord, such as those described in FIG. 1 to FIG. 7B can include a wireless router capable of acting as mobile Wi-Fi hotspot. This allows the multiple-socket power block or extension cord to be used on a worksite not just to make power more accessible, but turn a worksite into a Wi-Fi hotspot. This is useful, as construction sites often do not have access to wired internet connections. In certain embodiments a multiple-socket power block or extension cord, such as those described in FIG. 1 to FIG. 7B can include a wireless extender/booster.

The power cords and extension cords described above can be configured to accommodate a variety of electrical devices and appliances. The cord length, the number of wires, the gauge of each wire and the insulation of the outer sheath can be configured to meet the power and current requirements of electrical devices, and combinations of electrical devices, that can connect to one or more of the available sockets.

While particular elements, embodiments and applications of the present invention have been shown and described, it will be understood that the apparatus can comprise some or all of the elements, features and functionality described above.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A power cord comprising:

a. a male plug;

b. a first length of electric wire;

c. an end socket;

d. a second length of electric wire;

e. a socket box located between said first length of electric wire and said second length of electric wire, said socket box comprising:

i. a first socket;

ii. a second socket, wherein said second socket is configured to connect to a different type of connector than said first socket;

iii. a ground fault interrupter;

iv. a USB port; and v. a wireless router;

f. a securing sheath configured to permanently secure said end socket to a second male plug;

g. a first switch configured to control the flow of power to said first socket; and h. a second switch configured to control the flower of power to said second socket.

2. The power cord of claim 1 wherein said second electrical plug is connected to a power tool.

3. The power cord of claim 1 wherein said securing sheath is a length of waterproof heat shrinking tubing.

4. A power block comprising:

a. a male plug;

b. a socket box comprising;

i. a first socket;

ii. a second socket configured to connect to a different type of connector than said first socket;

iii. a USB port;

iv. a wireless router; and v. a ground fault interrupter comprising:

1. a test button; and 2. a reset button;

c. a magnet located on said socket box;

d. a clip located on said socket box; and e. a third socket located opposite said male plug, wherein said socket box is located between said male plug and said third socket;

f. a first switch configured to control the flow of power to said first socket; and g. a second switch configured to control the flower of power to said second socket.

5. The power block of claim 4 wherein said clip is configured to attach said power block to a utility belt.

6. The power block of claim 4 wherein said magnet is configured to attach said power block to a ladder.

* * * * *